US005413051A

United States Patent [19]

Tseng

[11] Patent Number: 5,413,051

[45] Date of Patent: May 9, 1995

[54] DRAWING TABLE

[75] Inventor: Chun-Chu Tseng, Taipei, Taiwan, Prov. of China

[73] Assignee: Chin JWU Enterprise Co., Ltd., Taipei, Taiwan, Prov. of China

[21] Appl. No.: 159,329

[22] Filed: Nov. 30, 1993

[51] Int. Cl.[6] ..... A47F 5/12

[52] U.S. Cl. ..... 108/6; 108/9; 108/10

[58] Field of Search ..... 108/6, 5, 10, 8, 9, 108/1, 7

[56] References Cited

U.S. PATENT DOCUMENTS

| | | | |
|---|---|---|---|
| 836,551 | 11/1906 | Werner | 108/9 |
| 1,915,802 | 6/1933 | Roshnell | 108/10 |
| 3,640,228 | 2/1972 | Busse | 108/6 |
| 3,988,021 | 10/1976 | Grover | 108/10 X |
| 4,196,675 | 4/1980 | Cook | 108/6 |
| 5,197,393 | 3/1993 | Yeakle | 108/10 |

FOREIGN PATENT DOCUMENTS

| | | | |
|---|---|---|---|
| 1376410 | 9/1964 | France | 108/10 |

*Primary Examiner*—Jose V. Chen

*Attorney, Agent, or Firm*—Jacobson, Price, Holman & Stern

[57] ABSTRACT

A drawing table includes two parallel stands, two top supports pivoted to the stands at the top and supported on short horizontal rods on the stands by a second adjusting device being controlled to adjust the angular positions of the top supports on the stands, a drawing board mounting frame having a front side pivoted to two parallel top supports and a rear side connected to the stands by a first adjusting device being controlled to adjust the angular position of the drawing board mounting frame on the top supports, two lifting gears mounted on an upper cross rod between the stands and respectively connected to the drawing board mounting frame and a cross rod between the top supports, and two tie rods mounted on a bottom cross rod between the stands and respectively connected to either short horizontal rod.

5 Claims, 4 Drawing Sheets

DRAWING TABLE

BACKGROUND OF THE INVENTION

The present invention relates to a drawing table having two adjusting devices mounted on two horizontal supporting rods between two stands thereof to support a drawing board mounting frame and two top supports being respectively pivoted to the drawing board mounting frame, two lifting gears mounted on an upper cross rods between the stands and respectively connected to the drawing board mounting frame and a cross rod between the top supports, wherein the position of the drawing board which is carried on the drawing board mounting frame is adjusted by adjusting the adjusting devices and the lifting gears.

FIG. 4 shows a structure of drawing table according to the prior art which is generally comprised of a stand 8 having two hollow posts 81 disposed at two opposite sides, two supporting rods 82 respectively fastened to the posts 81 at the top by tightening up screws 83, a drawing board mounting frame 84 having two opposite sides respectively pivoted to the supporting rods 82, a drawing board 85 mounted on the drawing board mounting frame 84, two curved connecting rods 86 bilaterally connected between the drawing board mounting frame 84 and the posts 81. Each curved connecting rod 86 has a fixed top end fastened to the drawing board mounting frame 84 and a free bottom end inserted through a hole 88 on a respective adjusting knob 83 and retained to either post 81 by the respective adjusting knob 83. Because of the limitation of the curved connecting rods 86, the adjustment of the angular position of the drawing board is limited to a narrow range. If the adjusting knobs 83 are loosened during an adjustment, the curved connecting rods 86 may drop suddenly, causing the hands injured.

SUMMARY OF THE INVENTION

The present invention has been accomplished to provide a drawing table which eliminates the aforesaid problems. According to one aspect of the present invention, the drawing table is comprised of two parallel stands, two top supports pivoted to the stands at the top and supported on short horizontal rods on the stands by a second adjusting device being controlled to adjust the angular positions of the top supports on the stands, a drawing board mounting frame having a front side pivoted to two parallel top supports and a rear side connected to the stands by a first adjusting device being controlled to adjust the angular position of the drawing board mounting frame on the top supports. Each adjusting device is comprised of a horizontal supporting rod connected between the stands at a different elevation, a plurality of sleeves mounted on the horizontal supporting rod, clamping devices mounted on the horizontal supporting rod and retained between the sleeves and controlled by an adjustment knob to hold adjustment rods at the desired elevation. The adjustment rods of the first and second adjusting devices are respectively connected to the drawing board mounting frame and the top supports. Therefore, the position of the drawing board can be conveniently adjusted.

According to another aspect of the present invention, two lifting gears are mounted on an upper cross rod between the stands and respectively connected to the drawing board mounting frame and a cross rod between the top supports, therefore the angular position of the drawing board mounting frame relative to the stands can be conveniently adjusted.

According to still another aspect of the present invention, two tie rods mounted on a bottom cross rod between the stands and respectively connected to either short horizontal rod. Each tie rod is comprised of two rod sections connected by a turnbuckle. By turning the turnbuckles of the tie rods, the stands are firmly retained in place.

DETAILED DESCRIPTION OF THE PREFERRED EMBODIMENT

Figure 1:
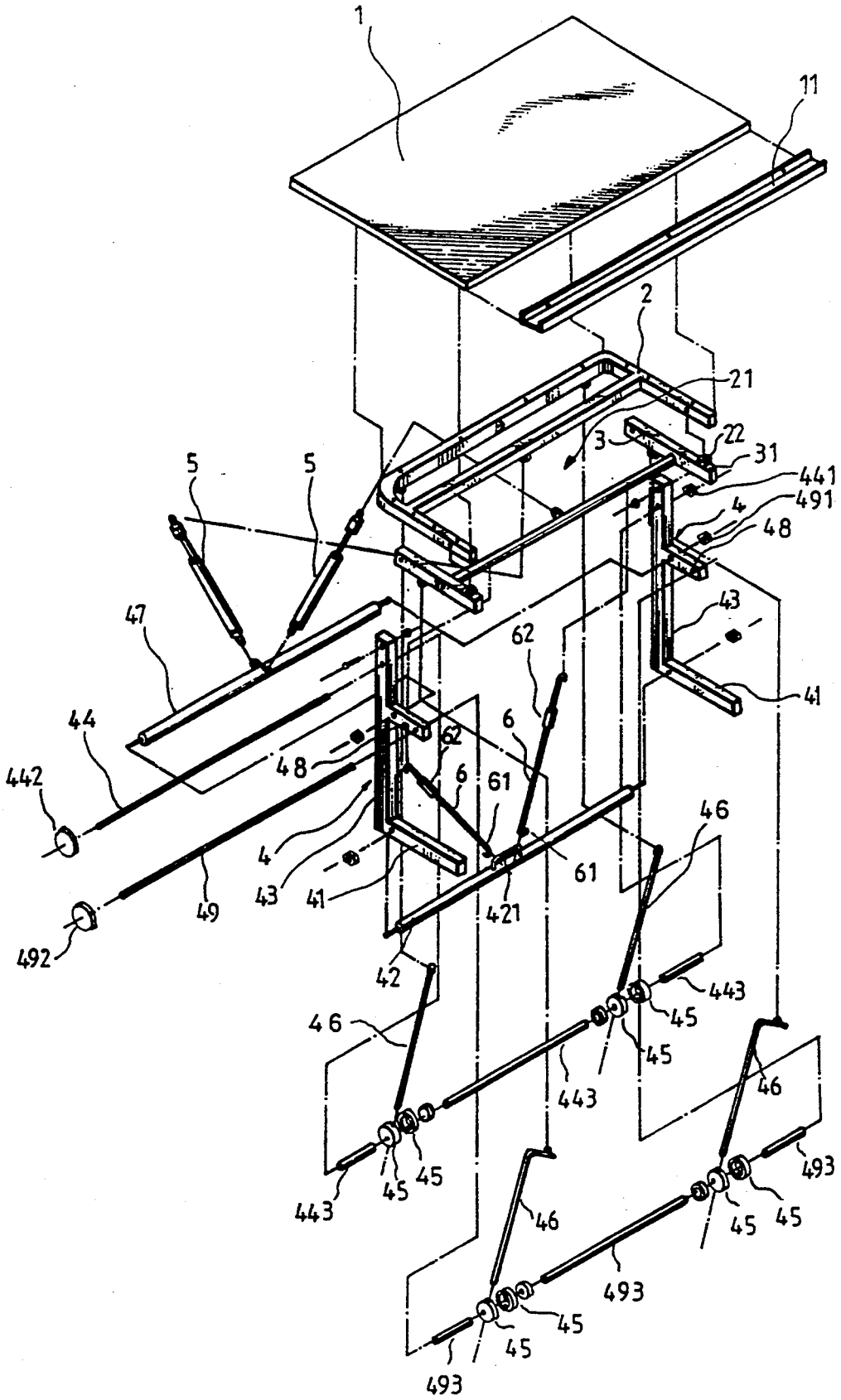
FIG. 1 is an exploded view of a drawing table according to the preferred embodiment of the present invention.
Figure 2:
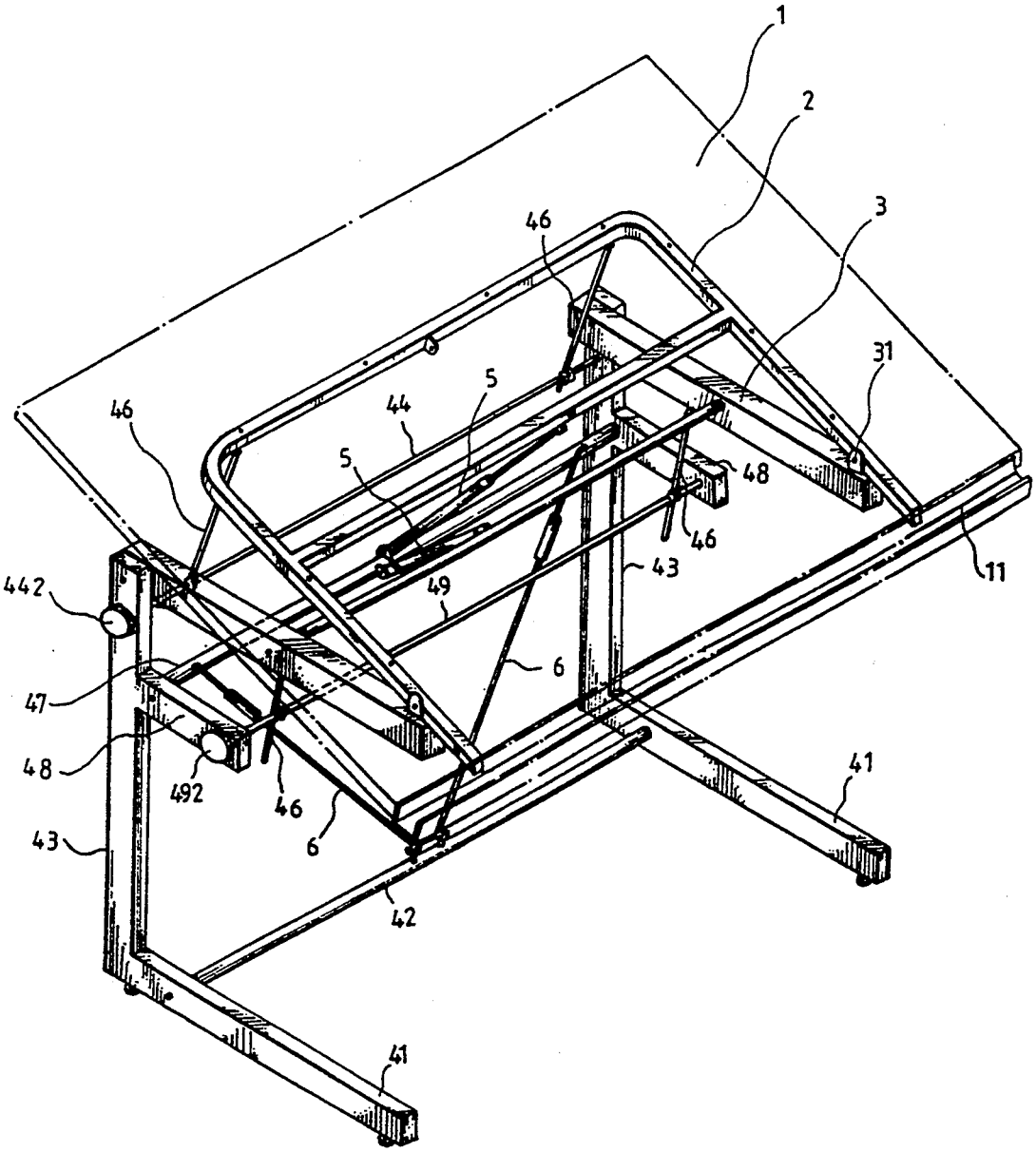
FIG. 2 is an elevational view of the drawing table of FIG. 1.
Figure 3:
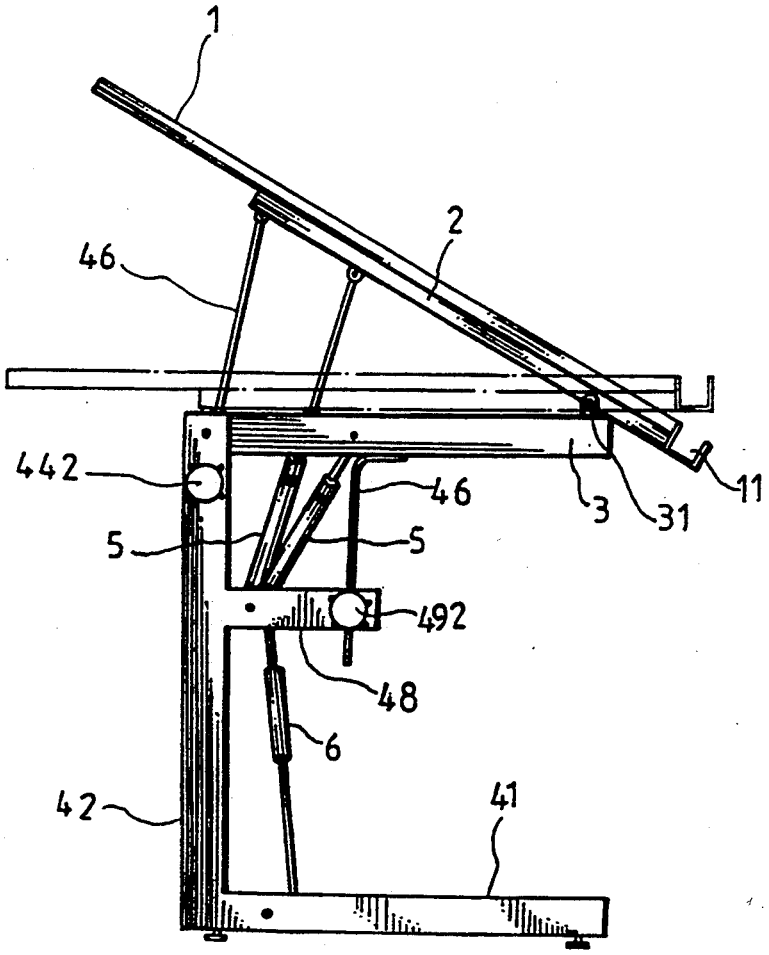
FIG. 3 is a side view showing the drawing board adjusted.
Figure 4:
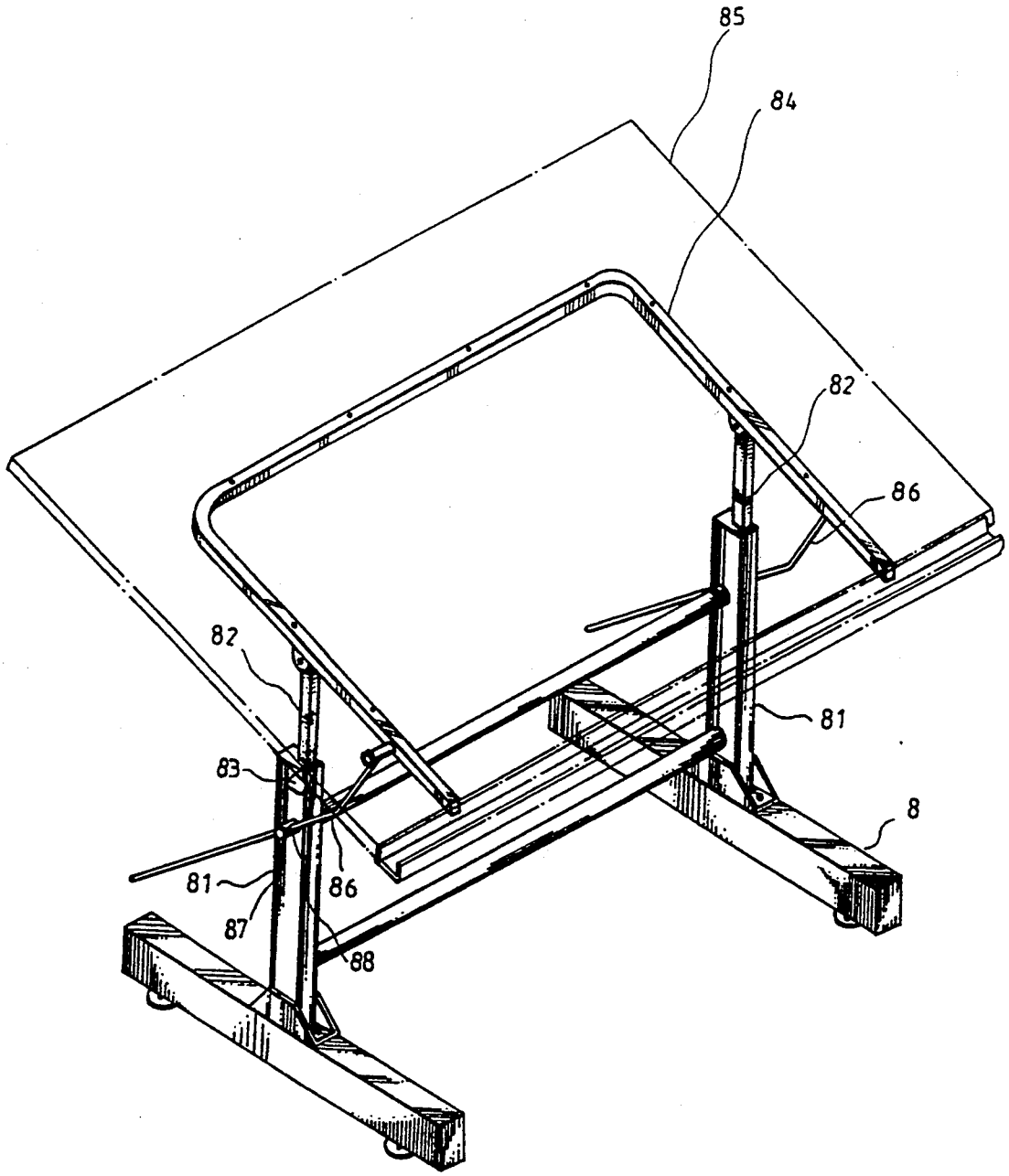
FIG 4 PRIOR ART
FIG. 4 is a perspective view of a drawing table according to the prior art.

Referring to FIGS. 1, 2, and 3, a drawing table in accordance with the preferred embodiment of the present invention is generally comprised of a drawing board 1, a drawing board mounting frame 2, two top supports 3, two stands 4, two lifting gears 5, and two tie rods 6.

Referring to FIG. 1 again, the drawing board 1 is mounted on the drawing board mounting frame 2, having a channel bar 11 fastened to the front side thereof (the side closest to the drawer). The drawing board mounting frame 2 is made of a substantially U-shaped open frame. A pivot 22 located on each front end of the top supports 3 respectively. The two ends of the drawing board mounting frame 2 are pivoted respectively to the two top supports 3 by inserted pin into the pin hole of the pivots 22. The two top supports 3 are respectively pivoted to the stands 4, A cross rod 32 is connected between the top supports 3, and therefore the top supports 3 are maintained in parallel with each other. The stands 4 are respectively comprised of a long horizontal rod 41 and a vertical rod 43 connected at right angles. The long horizontal rod 41 is disposed at the bottom to support, the drawing table on the ground. A bottom cross rod 42 is connected between the horizontal rods 41 of the stands 4 to keep the stands 4 n parallel with each other. A first horizontal supporting rod 44 is supported between the stands 4, having one end made with an outer thread inserted through a hole (not shown) on one stand 4 and threaded into a screw nut 441 and an opposite end inserted through a hole (not shown)on the other stand 4 and coupled with an adjustment knob 442. A plurality of sleeves 443 are mounted around the first horizontal supporting rod 44 between the vertical rods 43 of the stands 4. Two clamping devices 45 are respectively mounted around the first horizontal supporting rod 44 between the sleeves 443 to hold one end of a respective adjustment rod 46. The other end of each adjustment rod 46 is respectively connected to the drawing board mounting frame 2 at locations spaced from the pivot pins 22. The vertical rod 43 of each stand 4 comprises a short horizontal rod 48 disposed in parallel with the respective long horizontal rod 41 and at an elevation below the top supports 3. An upper cross rod 47 having a hole on each end is connected between the vertical rods 43 of the stands 4 and disposed in parallel with the first horizontal supporting rod 44 at a lower elevation. A second horizontal supporting rod 49 is supported between the short horizontal rods 48 of the stands 4, having one end made with an outer thread inserted through a hole (not shown) on one short horizontal rod 48 and threaded into a screw nut 491 and an opposite end inserted through a hole (not shown) on the other short horizontal rod 48 and coupled with an adjustment knob 492. A plurality of sleeves 493 are mounted around the second horizontal supporting rod 49. Two clamping devices 45 are respectively mounted around the second horizontal supporting rod 49 between the sleeves 493 to hold one end of a respective adjustment rod 46. The other end of each adjustment rod 46 on the second horizontal supporting rod 49 is respectively connected to either top support 3.

The two lifting gears 5 are respectively mounted on the upper cross rod 47. The opposite end of one lifting gear 5 is connected to the drawing board mounting frame 2. The opposite end of the other lifting gear 5 is connected to the cross rod 32 between the two top supports 3.

The bottom cross rod 42 comprises a lug 421 in the middle to hold the two tie rods 6. Each tie rod 6 has a bottom end terminated to a hook 61 hooked on the lug 421 of the bottom cross rod 42 and a top end respectively inserted through the hole on the end of the upper cross rod 47. Each tie rod 6 is comprised of two rod sections connected by a turnbuckle 62. The turnbuckle 62 can be adjusted to change the tension of the respective tie rod 6.

Referring to FIGS. 2 and 3 again, when set up, the position of the drawing board 1 can be conveniently adjusted. The adjusting procedure is outlined hereinafter, The adjustment knobs 442;492 are respectively loosened to release the sleeves 443;493 from the clamping devices 45 permitting the adjustment rods 46 to be moved vertically, and therefore the elevations of the drawing board mounting frame 2 and the top supports 3 are adjusted, namely, the elevation of the drawing board 1 is adjusted. When adjusted, the adjustment knobs 442;492 are respectively tightened, causing the clamping devices 45 to hold the adjustment rods 46 in the respective adjusted positions. The angular positions and elevations of the drawing board mounting frame 2 and the top supports 3 can also be adjusted by adjusting the elevations of the lifting gears 5 and the adjustment rods 46, and therefore the drawing board 1 can be adjusted to the desired angular position and elevation.

What is claimed is:

1. A drawing table comprising a drawing board mounted on a drawing board mounting frame supported on a base frame wherein said base frame comprises two symmetrical stands, each stand having a long horizontal rod at the bottom; a vertical rod connected to the long horizontal rod at right angles; and a short horizontal rod extended from the vertical rod above the long horizontal rod; a bottom cross rod connected between the long horizontal rods of said stands; two top supports connected between said stands and said drawing board mounting frame, each top support having a rear end pivoted to the vertical rod of either stand at the top and a front end pivoted to either side of said drawing board mounting frame at the front; an upper cross rod connected between the short horizontal rods of said stands; a first adjusting device fastened to said vertical rods of said stands and connected to a rear side of said drawing board mounting frame for adjusting the elevation of the rear side of said drawing board mounting frame; a second adjusting device fastened to said short horizontal rods of said stands and connected to said top supports to adjust the elevation of the front ends of said top support; said first adjusting device comprising a first horizontal supporting rod extending between each vertical rod of said stands, and being adjustably fastened at one end; a plurality of first sleeves mounted around said first horizontal supporting rod; two first clamping devices mounted around said first horizontal supporting rod and retained between said first sleeves; and two first adjustment rods connected between the rear side of said drawing board mounting frame and said first clamping devices, each first adjustment rod having a fixed top end pivoted to said drawing board mounting frame and a free bottom end clamped by at least one of said first clamping devices; said second adjusting device comprising a second horizontal supporting rod extending between each short horizontal rod of said stands and being adjustably fastened at one end; a plurality of second sleeves mounted around said second horizontal supporting rod; two second clamping devices mounted around said second horizontal supporting rod and retained between said second sleeves; and two second adjustment rods connected between the said top supports and said second clamping devices, each second adjustment rod having a fixed top end pivoted to either top support and a free bottom end clamped by at least one of said second clamping devices; and whereby the drawing board elevation can be adjusted by loosening of either of said first or second adjusting devices at the adjustable end of the respective horizontal support rods, and the respective clamping devices are released from the respective sleeves to release the respective adjustment rods for permitting the respective adjustment rods to be moved vertically on the respective clamping devices.

2. The drawing table of claim 1 further comprising a first lifting gear having one end fastened to a middle region of said upper cross rod and an opposite end connected to said drawing board mounting frame, and a second lifting gear having one end fastened to a middle region of said upper cross rod and an opposite end connected to a cross rod between said top supports.

3. The drawing table of claim 1 further comprising two tie rods respectively connected between said bottom cross rod and said upper cross rod, each tie rod having a bottom hook end attached to a lug on said bottom cross rod, and being comprised of two rod sections connected by a turnbuckle.

4. The drawing table of claim 1 wherein the first horizontal rod is adjustably fastened through an adjustment knob.

5. The drawing table of claim 1 wherein the second horizontal rod is adjustably fastened through an adjustment knob.

* * * * *